US005992027A

United States Patent [19]

Mack

[11] Patent Number: 5,992,027

[45] Date of Patent: Nov. 30, 1999

[54] METHOD OF DETERMINING THE CORRECT SIZE IN WOMEN'S SEWING PATTERNS

[76] Inventor: Helen Mack, 1-1283 Bernard Avenue, Kelowna, British Columbia, Canada, V1Y 6R3

[21] Appl. No.: 08/794,234

[22] Filed: Jan. 30, 1997

[51] Int. Cl.[6] ..... A41H 3/00

[52] U.S. Cl. ..... 33/12; 33/17 A

[58] Field of Search ..... 33/11, 12, 14, 33/15, 16, 17 A, 17 R, 24

[56] References Cited

U.S. PATENT DOCUMENTS

| | | | |
|---|---|---|---|
| 1,254,912 | 1/1918 | Jenkins | 33/17 R |
| 1,961,115 | 5/1934 | Van Patten | 33/12 |
| 2,106,729 | 2/1938 | Fichtol | 33/15 |
| 3,609,766 | 10/1971 | Olive | 33/17 A |
| 3,979,831 | 9/1976 | Lutz | 33/17 |
| 4,184,260 | 1/1980 | Brockman | 33/15 |
| 4,868,990 | 9/1989 | Steinberg | 33/15 |
| 4,899,448 | 2/1990 | Huang | 33/17 |
| 5,555,629 | 9/1996 | Leighton | 33/12 |

*Primary Examiner*—Bernard Roskoski
*Attorney, Agent, or Firm*—Antony C. Edwards

[57] ABSTRACT

A method of selecting a commercial clothing pattern size for a user includes the step of comparing a neck size of the user to a numerical table, wherein the numerical table has a range of neck sizes corresponding to a corresponding range of clothing pattern sizes. A clothing pattern size corresponding to the neck size is then selected from the numerical table.

1 Claim, 10 Drawing Sheets

METHOD OF DETERMINING THE CORRECT SIZE IN WOMEN'S SEWING PATTERNS

FIELD OF THE INVENTION

This invention relates to the field of home sewing, and, in particular, to a method of determining the correct size of women's sewing patterns based on neck size so as to formulate personal sewing pattern adjustment codes re-usable from pattern to pattern.

BACKGROUND OF THE INVENTION

To date, sewing pattern sizes are determined according to the bust size of the user. Once pattern size according to bust is selected, the pattern template is adjusted to provide a customized fit, typically by folding, cutting and pasting the various pieces of the pattern. Bust sizes vary greatly on women and when patterns are determined by bust size, they typically do not fit the neck, shoulder and armscye of the user and cannot be adjusted easily. This is because the user must adjust curved lines which get distorted. On the other hand, using a pattern closest to the user's neck size according to the present invention, the user generally only has to add or subtract circumference to the bust, waist, hips and sleeves to adjust the pattern to obtain a customized fit. Using sewing patterns according to the present invention results in a re-usable personal adjustment code for application to sewing patterns which is a result of comparing the user's personal measurements against the corresponding pattern measurements.

SUMMARY OF THE INVENTION

Applicant has discovered that once a user establishes the user's correct size, and makes a test garment using the users personal code for alterations, and is satisfied with the fit, the user may apply these same alterations to all patterns in the user's neck size because the neck size remains the same for the user unless the user has a substantial weight gain. This establishes the user's pattern size for all future sewing by the user. Bust and/or hip sizes are still used to determine the amount of fabric required for the garment.

In summary, a method of developing a personal adjustment code and a method of instructing a user for correct sizing and adjusting of a conventional clothing pattern for a person includes the steps of:

(a) measuring the person's neck size and other personal body measurements conventionally required to adjust a conventional clothing pattern;

(b) selecting the conventional clothing pattern closest to, or approximating having substantially the same neck size as the person's neck size;

(c) comparing the person's personal body measurements to the corresponding flat measurements on the conventional clothing pattern having approximately the same neck size as the person's neck size; and (d) determining the differences between the personal measurements and the corresponding flat measurements on the conventional clothing pattern, wherein the differences between the personal measurements and the corresponding flat measurements on the conventional clothing pattern represent the adjustments that must be made to the conventional clothing pattern to adjust the conventional clothing pattern for fabrication of a garment adjusted to fit the person.

Advantageously the method includes the further step of recording the differences between the personal measurements and the corresponding flat measurements on the conventional clothing pattern to form a personal adjustment code for later re-use on other conventional clothing patterns having the same neck size as that of the conventional clothing pattern.

Further advantageously, the differences between the personal measurements and the corresponding flat measurements on the conventional clothing pattern are adjusted for required ease.

Following this method, i.e. developing and using a personal adjustment code for re-use on other sewing patterns having the same neck size, as opposed to bust size which is conventionally relied on, reduces or eliminates further adjustments to sewing patterns, and may eliminate the need for a trial garment, unless the person has gained or lost substantial weight, for example gained or lost more than five to ten pounds.

The development of the personal adjustment code is keyed on the person's neck size. A person's neck size is more accurate than, for example, bust size, as a person's neck size generally does not vary greatly on each individual, as compared to bust size variation. This method of the present invention is applicable to different body sizes, whether short, tall, fat, or thin.

Table 1 below. The nearest neck measurement in the size chart is used to determine the appropriate conventional pattern size. Using by way of example of a 13½ inch neck measurement, size 8 is the appropriate pattern size the user would choose from a pattern catalogue.

TABLE 1

Size Chart

| | PATTERN SIZE | | | | | | | | | |
|---|---|---|---|---|---|---|---|---|---|---|
| | 6 | 8 | 10 | 12 | 14 | 16 | 18 | 20 | 22 | 24 |
| Neck Measurement | 13 | 13½ | 14 | 14½ | 15 | 15½ | 16 | 16½ | 16¾ | 17 |

TABLE 2

| Row No. ↓ | | Column No. → 1 Pattern Measurement | 2 Personal Measurement | 3 Standard Ease | 4 Personal Measurement + Standard Ease (column 2 + column 3) | 5 Overall Adjustment | 6 Personal Adjustment Code to be Applied to Pattern Piece |
|---|---|---|---|---|---|---|---|
| 1 | Back Waist Length 28 | | | ⅜" | | | |
| | | | | 1 cm | | | |
| 2 | Shoulder Tip to Shoulder Tip 30 | | | 0 | | | |
| 3 | Shoulder to Wrist 32 | | | 0 | | | |
| 4 | Girth 34 | | | 2" | | | |
| | | | | 5 cm | | | |
| 5 | Neck Measurement 36 | | | 0 | | | |
| 6 | Front Shoulder to Waist 38 | | | ⅜" | | | |
| | | | | 1 cm | | | |
| 8 | Bust 42 | | | 4" | | | |
| | | | | 10 cm | | | |
| 9 | Waist 44 | | | 2" | | | |
| | | | | 5 cm | | | |
| 10 | High Hip 46 | | | 2" | | | |
| | | | | 5 cm | | | |
| 11 | Full Hip 48 | | | 4" | | | |
| | | | | 10 cm | | | |
| 12 | Hip Depth 50 | | | 0 | | | |

DETAILED DESCRIPTION OF THE PREFERRED EMBODIMENT

Figure 1:
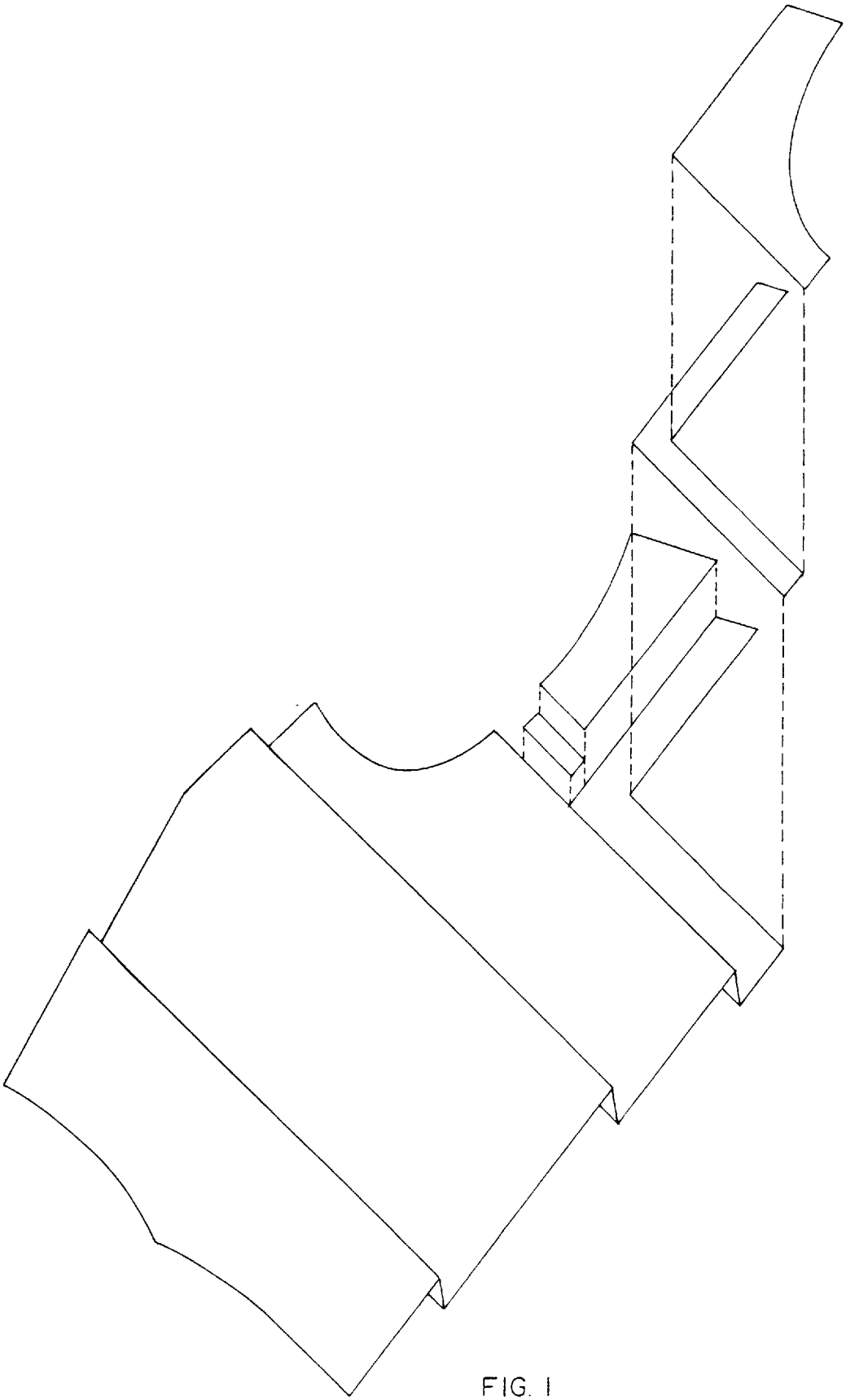
FIG. 1 PRIOR ART
FIG. 1 is, in exploded view, a prior art sewing pattern piece showing typical adjustments.

Illustrated in FIG. 1 is a conventional size 14 bodice front sewing pattern template which has been folded and cut in a conventional manner, so as to be ready to be pasted or taped together into a single template sheet, for a user having a 16 inch back waist length, a 36 inch (that is, size 14) bust, a 35 inch high chest, a 13¾ inch neck, a 27½ inch waist, and a 36 inch hip measurement.

Figure 2:
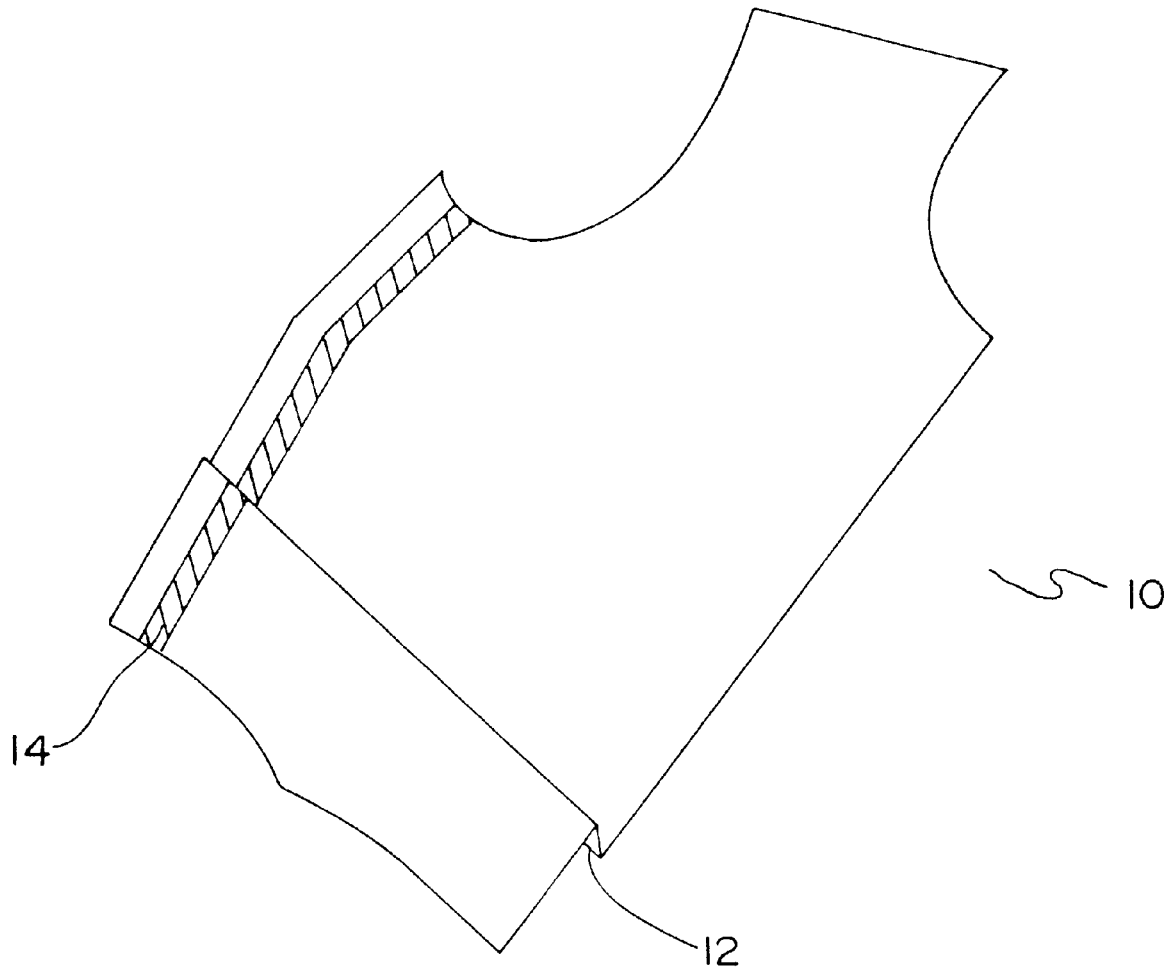
FIG. 2 is a sewing pattern piece adjusted according to the method of the present invention.

Illustrated in FIG. 2, for a user having the same measurements, is the same bodice front in a size 10 showing the single fold 12 and single expansion adjustment 14 required to customize the fit of the size 10 sewing pattern. The number of adjustments are significantly reduced because the pattern size was chosen according to neck size rather than bust size.

Figure 3A:
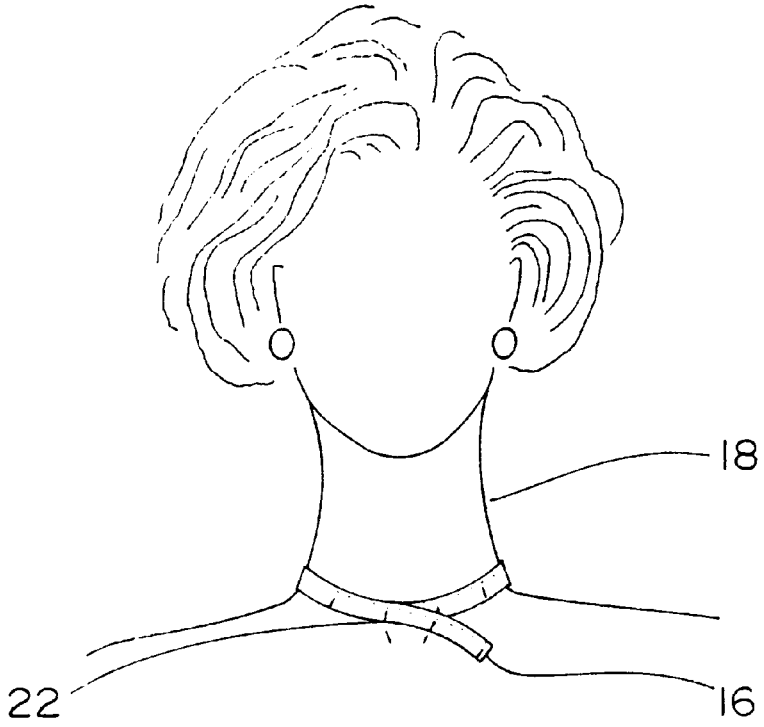
FIG. 3*a* is, in front elevation view, the neck measurement of a user.
Figure 3B:
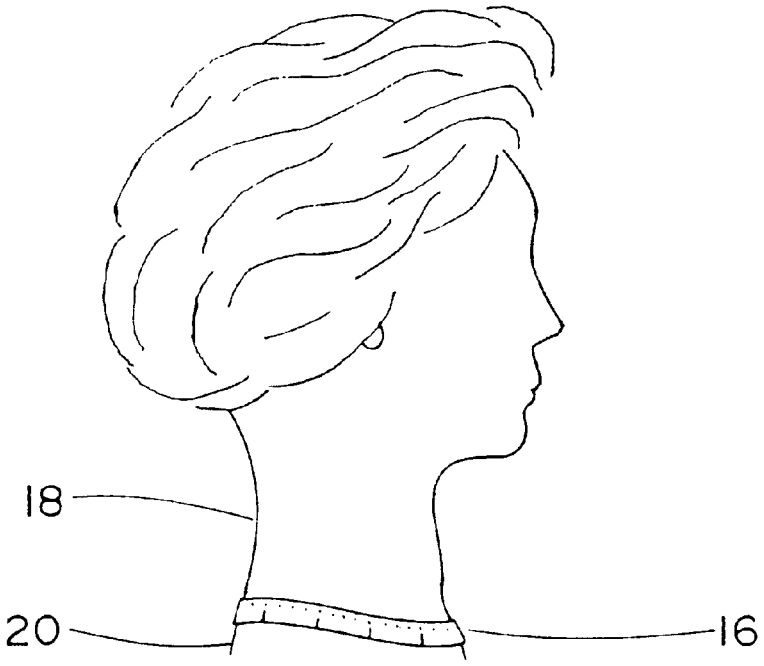
FIG. 3*b* is, in side elevation view, the neck measurement of FIG. 3*a*.
Figure 4A:
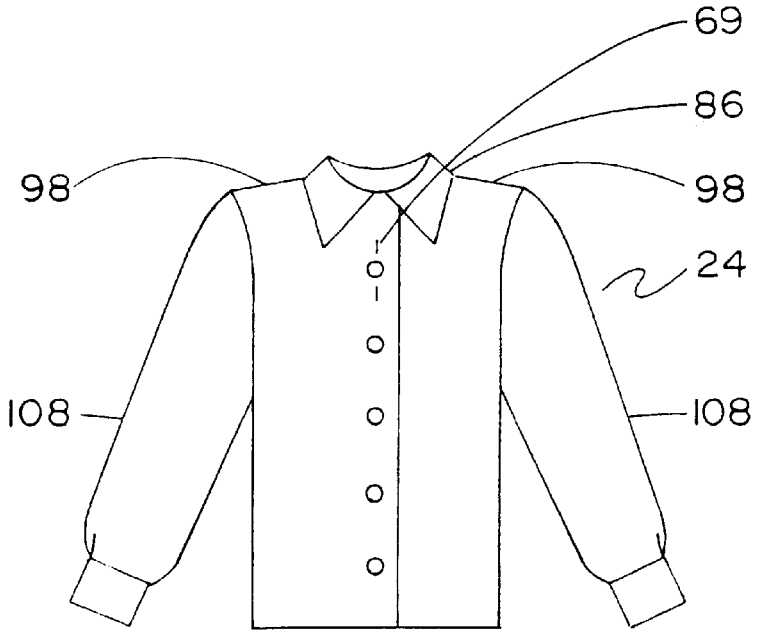
FIG. 4*a* is, in front elevation view, a blouse constructed from a blouse pattern and adjusted according to the method of the present invention.
Figure 4B:
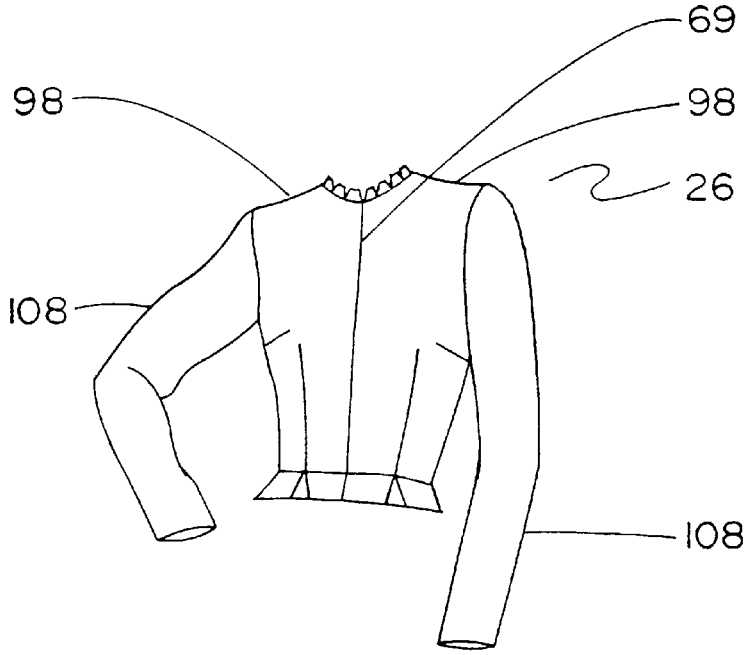
FIG. 4*b* is, in perspective view, a bodice fitting shell constructed from a bodice fitting pattern according to the method of the present invention.
Figures 5A, 5B:
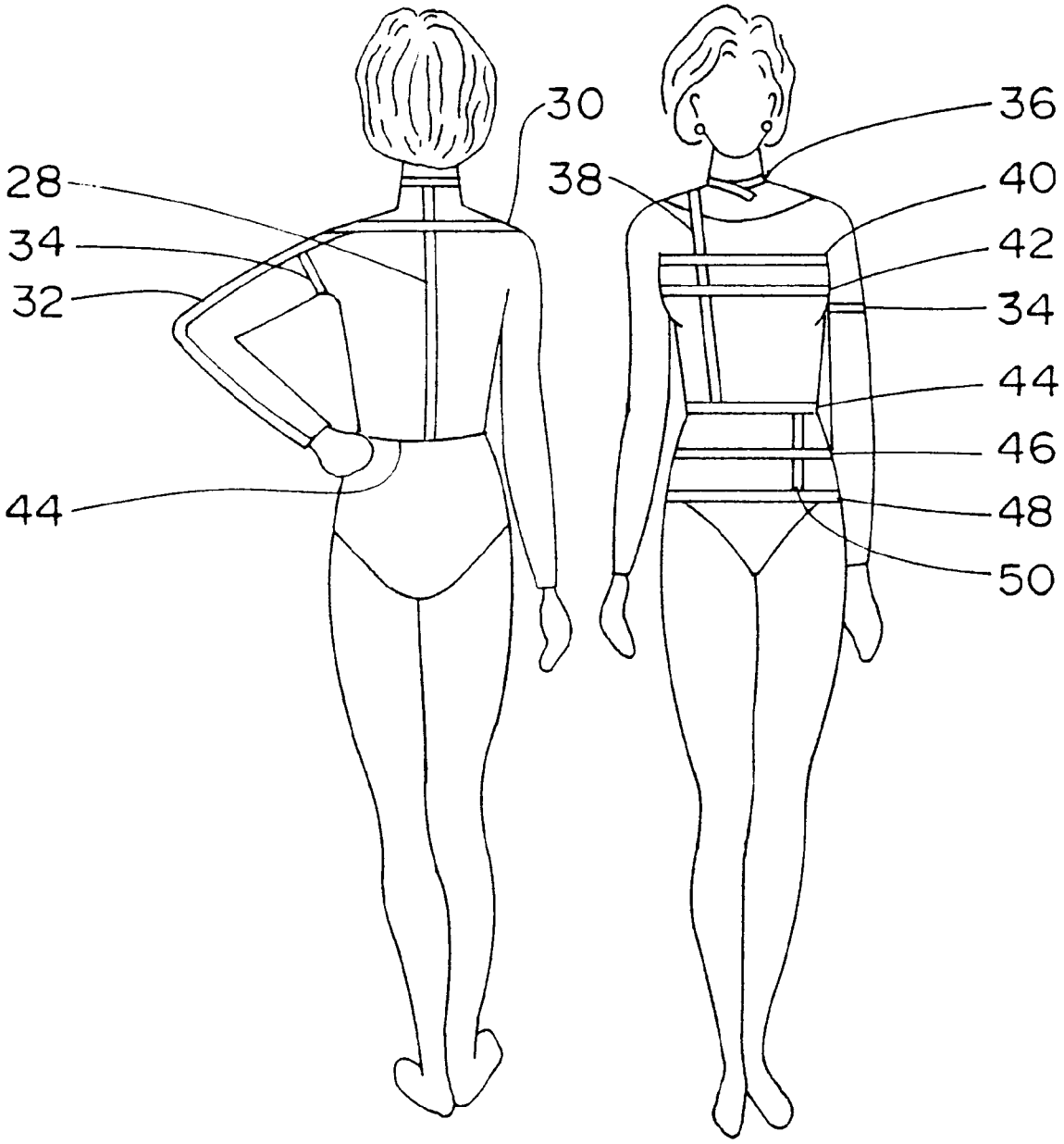
FIG. 5*a* is, in rear elevation view, conventional personal measurements of a user.
FIG. 5*b* is, in front elevation view, the personal measurements of the user of FIG. 5*a*.

To implement the preferred embodiment of the present invention a user as seen in FIGS. 3*a* and 3*b* determines neck size by placing a measuring tape 16 around neck 18, above prominent neck vertebrae 20 and over hollow 22 in front. The neck measurement is then recorded. The user then compares the neck measurement to the size chart shown in The user may test her pattern chosen according to her neck size by utilizing a multi-sized blouse-style pattern, which will result in blouse 24, which includes her neck size, a collar 86, normal shoulder line 98 and long sleeves, as seen in FIG. 4*a*, or a bodice fitting pattern, which will result in a basic bodice fitting shell 26 as seen in FIG. 4*b*. Once the user has measured her personal body measurements according to the measurements illustrated in FIGS. 5*a* and 5*b*, they are recorded in a table such as in Table 2. In particular, the following measurements are made and recorded:

back waist length measurement 28, shoulder tip-to-shoulder tip measurement 30, shoulder to wrist measurement 32, girth measurement 34, neck measurement 36, front shoulder to waist measurement 38, high chest measurement 40, bust measurement 42, waist measurement 44, high hip measurement 46, full hip measurement 48, and hip depth measurement 50.

The method of the present invention applied to a blouse style pattern 24 is as set out in the following steps:

1. For the back pattern 52, as illustrated in FIGS. 6 and 7:

(a) Flat measure back waist length 28 to waist 44 on pattern 52.

Figure 6A:
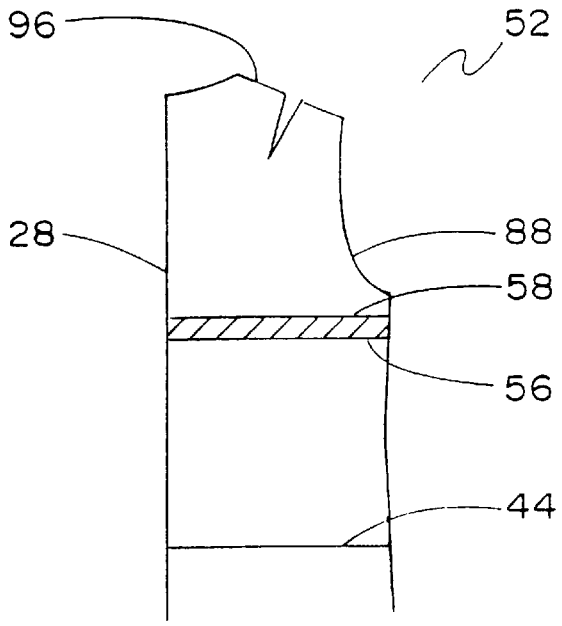
FIG. 6*a* is a back pattern piece adjusted according to the method of the present invention.
Figure 6B:
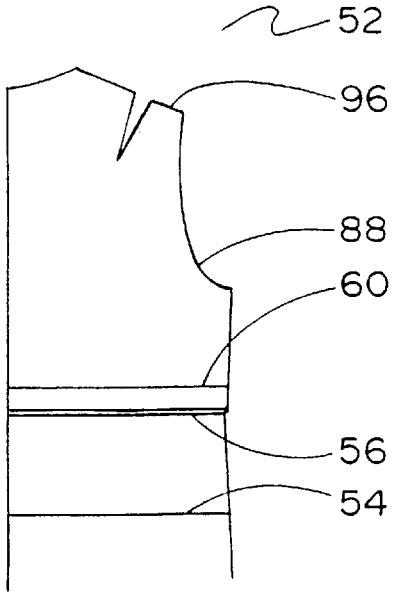
FIG. 6*b* is the back pattern piece of FIG. 6*a*, also adjusted according to the method of the present invention.
Figure 7A:
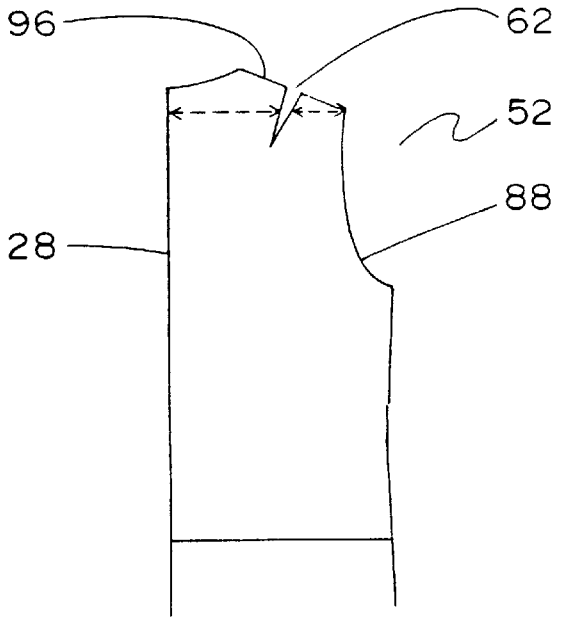
FIG. 7*a* is the back pattern piece of FIG. 6*a*, also adjusted according to the method of the present invention.

(b) If the flat measurement is different from the user personal back waist length measurement, adjust pattern 52 at adjustment line 56; to lengthen pattern 52, slash on adjustment line 56 and spread pattern desired amount to form expansion adjustment 58, (see FIG. 6*a*).

(c) To shorten pattern 52, fold pattern 52 on adjustment line 56 (see FIG. 6*b*) the amount of the desired adjustment, where, to make an accurate fold a line 60 is drawn on pattern 52 and then adjustment line 56 is brought to line 60 (this is an example of a folding method, to be inferred where folding is required hereinafter).

(d) Whatever adjustment is made to back pattern 52, the corresponding adjustment is made to the front pattern piece.

(e) Flat measure on pattern 52 one-half of shoulder tip-to-shoulder tip measurement 30 (because the measurement on pattern 52 corresponds to one-half the distance measured for shoulder tip-to-shoulder tip measurement 30 in Table 2). Fold out dart 62 if applicable. Compare one-half of pattern measurement 30 (i.e., from centre back, corresponding to measurement 28 in FIG. 6*a*, to armscye 88) to the corresponding user personal measurement. No ease is required. (See FIG. 7*a*).

Figure 7B:
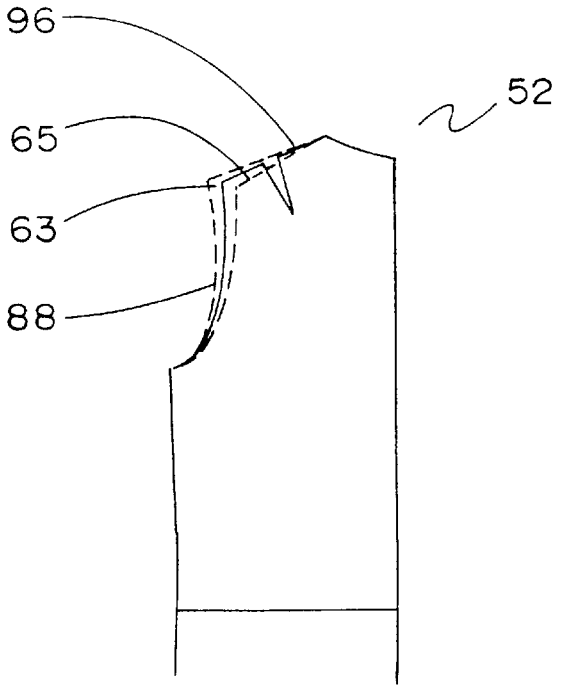
FIG. 7*b* is the back pattern piece of FIG. 6*a*, also adjusted according to the method of the present invention.
Figure 8A:
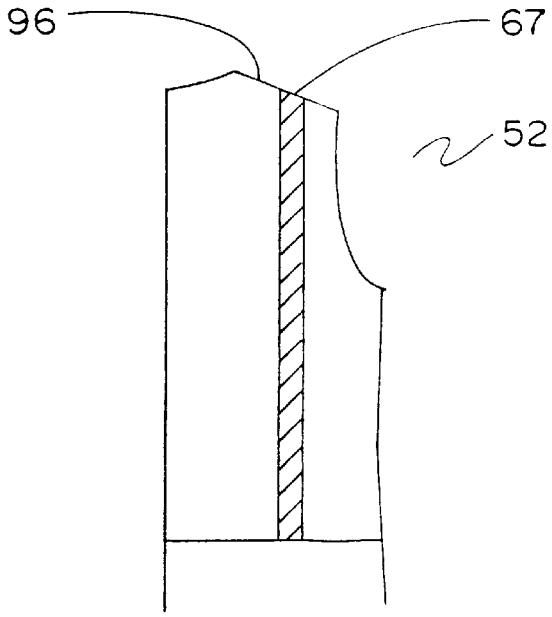
FIG. 8*a* is the back pattern piece of FIG. 6*a*, also adjusted according to the method of the present invention.
Figure 8B:
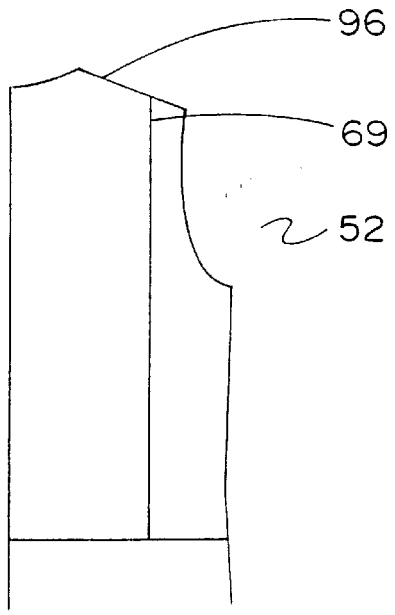
FIG. 8*b* is the back pattern piece of FIG. 6*a*, also adjusted according to the method of the present invention.

(f) Adjust if necessary as illustrated in FIGS. 8*a* and 8*b* by applying one-half amount of adjustment required shoulder tip-to-shoulder tip, as a consequence of working with pattern 52 which is only one half of the overall pattern. As seen in FIG. 7*b*, if the adjustment is ½ inch or more, adjust by either adding paper to each shoulder to create expansion zone 63 on each shoulder. If adjustment is ½ inch or less, draw line 65 on pattern and cut pattern 52 along line 65. If adjustment is more than ½ inch (1.4 cm), slash pattern down centre of shoulder to bottom and separate to create expansion adjustment 67 and insert tissue paper as seen in FIG. 8*a*. Repeat adjustment for front pattern piece. If the adjustment is to remove more than ½ inch, fold along line 69 as seen in FIG. 8*b*. Repeat for front.

Figure 9A:
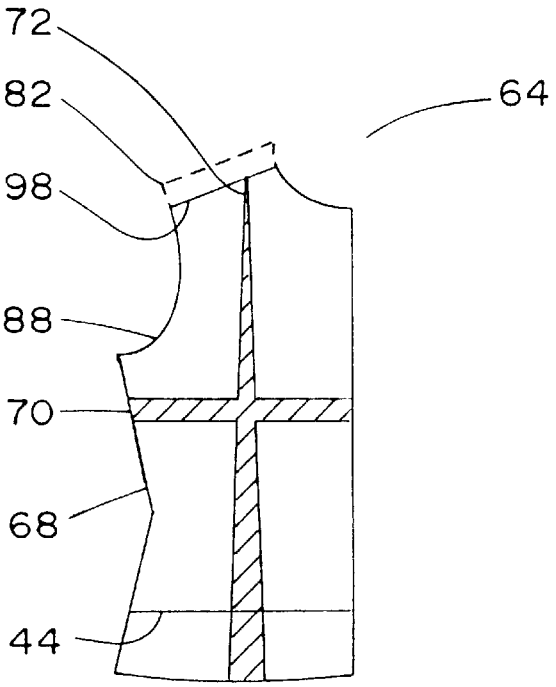
FIG. 9*a* is a front pattern piece adjusted according to the method of the present invention.
Figure 9B:
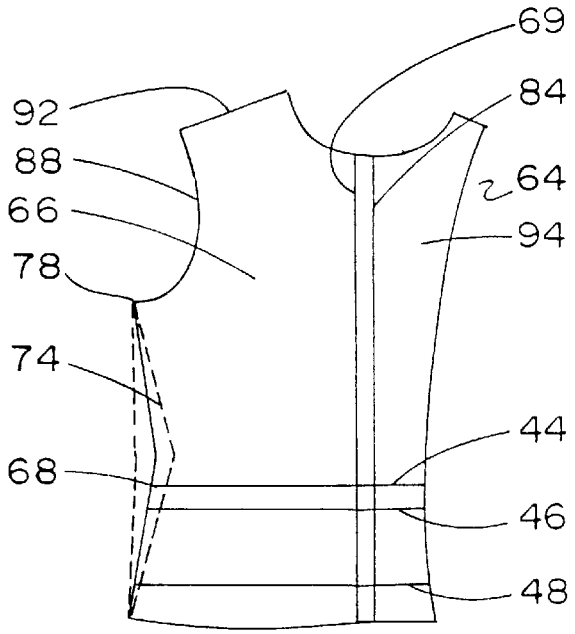
FIG. 9*b* is the front pattern piece of FIG. 9*a*, also adjusted according to the method of the present invention.

2. For the front pattern 64, as illustrated in FIGS. 9*a* and 9*b*:

(a) If pattern 64 has gathers or tucks, fold out before flat measuring.

(b) Flat measure adjusted pattern 64 from side seam 68, through bust point 66, to centre front line 69. 4 inches (10 cm) minimum ease is required, for total circumference at bust level.

(c) If greater circumference is required, add ¼ the amount to side seams 68. Up to 1½ inches (4 cm) may be added at each side seam.

(d) If more ease is necessary, slash pattern 64 along slash line 72 through waist dart up to shoulder line and along slash line 70 from centre front through side dart to side seam. Spread amount needed. (See FIG. 9*a*).

(e) For waist 44, compare personal measurement to pattern waist measurement and either add or take off ¼ the amount needed at side seam 68.

3. For the hip, in pattern 64, as illustrated in FIG. 9*b*:

(a) Flat measure pattern 74 at hipline 46 or 48, whichever is greater, front and back, from centre back and front respectively to side seam 68. 4 inches (10 cm) ease required.

(b) Compare to corresponding personal measurement, add or subtract ¼ the amount of adjustment, at side seam 68.

(c) Connect an adjusted side seam line 74 from underarm 76 to bottom of pattern 80. More may be added to waist and hip if necessary.

4. Complete pattern preparation and then cut out blouse 24 as follows:

(a) Allow 1 inch (2.5 cm) seam allowance at shoulder 82 in case you will need to square shoulder. This will be determined after shoulder seams are basted together.

(b) Trim all adjusted pattern pieces.

(c) Now that the pattern is adjusted, place pattern on fabric and cut out the fabric. Mark centre front line 69, centre back line (corresponding to indicator numeral 28 in FIG. 6*a*), mark fold line 84 at facing with clip marks (clip marks made in seam allowance).

(d) Mark placement of collar (usually on centre front line 69) on front pattern 64 with tailor tack or marking pencil. Collar 86 is not adjusted as no adjustments required at neck.

(c) Cut collars and mark centre back of collars with clip mark in seam allowance.

5. Construct front and back of blouse 24 as follows:

(a) Stay stitch neckline 90, along front shoulder 92 and along armscye 88.

(b) Press facing 94 on fold line 84. Baste front shoulder 92 and back shoulder 96 together at normal shoulder line 98 (at one inch in from edge of fabric, i.e. with 1 inch seam).

(c) Stitch side seams 68 at ⅝ inch in from edge of fabric (hereinafter, with the exception of shoulder lines, all seams are ⅝ inch in from edge).

(d) Put blouse on for shoulder adjustment. Pin baste along centre front of blouse to simulate wearing of blouse, i.e., to check fit of blouse as it would be worn. Check that shoulder lines fall along the top of the user's shoulders.

Figure 10A:
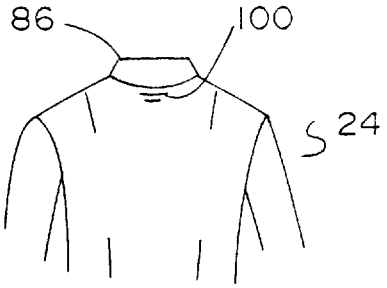
FIG. 10*a* is, in rear elevation view, the blouse of FIG. 4*a* requiring adjustment to remove wrinkles.
Figure 10B:
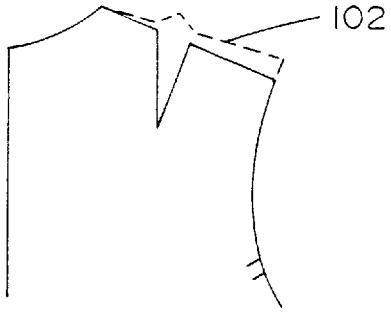
FIG. 10*b* is the back pattern picce of FIG. 6*a*, in partial view, showing required adjustments to be applied to the blouse of FIG. 10*a*.

(e) If blouse 24 has horizontal folds 100 at centre back neckline as seen in FIG. 10*a*, release shoulder seam along normal shoulder line 98 and determine how much shoulder needs squaring or adjusting. Restitch shoulder seam on adjustment line 102 to create new normal shoulder line 98 as seen in FIG. 10*b*.

(f) Shoulder seam should be in line with centre of arm.

Figure 11:
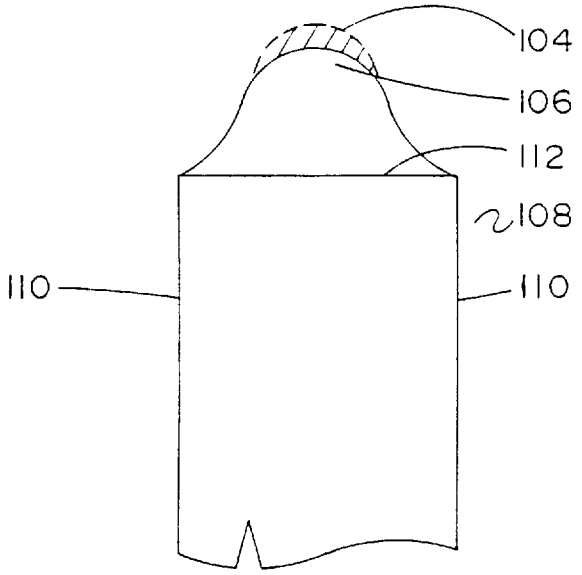
FIG. 11 is a sleeve pattern piece adjusted according to the method of the present invention.

(g) If shoulder was adjusted, for example, adjusted ⅜ inch (1 cm), add same amount 104 to top of sleeve cap 106, as seen in FIG. 11.

6. Construct sleeves 104 of blouse 24 as follows:

(a) If side seam 68 was adjusted, adjust sleeve seam 110 same amount so that sleeve cap 106 matches armscye 88.

(b) Flat measure sleeve bicep line 112 and compare to personal girth measurement 34. A minimum of 3 inches (7 cm) of ease is required, i.e. the sleeve pattern must be at least 3 inches larger than girth 34.

Figure 12:
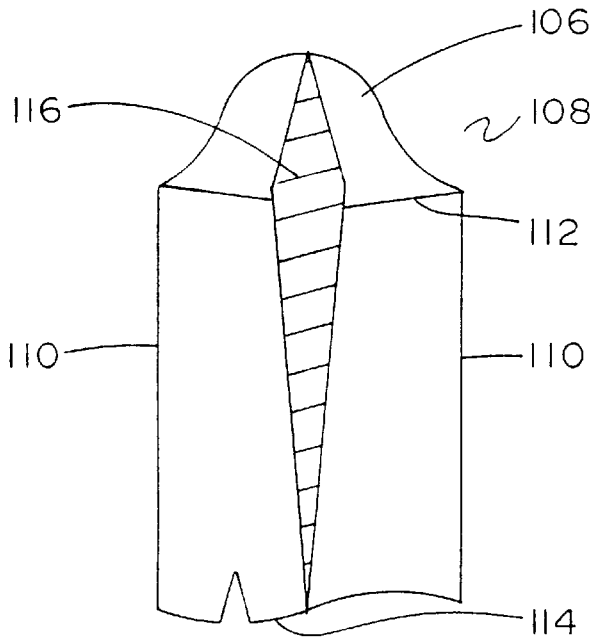
FIG. 12 is the sleeve pattern piece of FIG. 11, also adjusted according to the method of the present invention.

(c) If sleeve requires further adjustment to get minimum required ease, slash from wrist 114 to top of sleeve seam and spread required amount at bicep line 112 to create expansion adjustment 116 as seen in FIG. 12.

Figure 13:
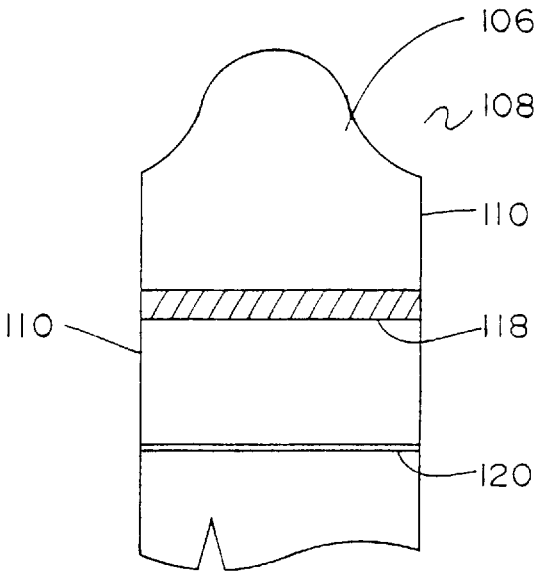
FIG. 13 is the sleeve pattern piece of FIG. 11, also adjusted according to the method of the present invention.

(d) If personal length measurement 32 requires that sleeve 108 be lengthened, slash at adjustment line 118 and adjust, as seen in FIG. 13.

(e) If sleeve 108 is too long, shorten by folding up amount required at fold line 120.

(f) Attach sleeve to armscye 88.

(g) Attach collar 86.

(h) Attach facings 94 and clip neck edge every ⅜ inch (1 cm) to allow collar to lie flat.

Blouse 24 so constructed has fashion ease, that is, it will be roomy but should fit smoothly over the shoulders. If no more adjustments are necessary, develop personal adjustment codes as set out below, and utilize this size for all future patterns.

Referring to Table 2, once columns 1 and 2 are completed, add columns 2 and 3 and enter total in column 4. Compare column 4 to the corresponding entry in column 1. If column 1 entry is greater than column 4 entry, then column 5 entry (Overall Adjustment to the Pattern) is column 1 minus column 4, the resulting entry requiring a fold in the pattern in that amount.

If column 1 entry is less than column 4 entry, then column 5 entry is column 4 minus column 1, the resulting entry requiring an expansion of the pattern in that amount.

If a fold is required in the pattern, it is indicated by a "−" (minus) sign in column 6. If an expansion is required in the pattern, it is indicated by a "+" (plus) sign in column 6.

The Overall Adjustment entries in column 5 are entered directly into column 6 in rows 1, 3, 5, 6, and 12. In row 4 the Overall Adjustment entry in column 5 is divided by 2 (i.e. halved) and the resulting number entered into column 6. The remaining Overall Adjustment entries in column 5 are divided by 4 (i.e. quartered) and the resulting numbers entered into column 6.

The end result in column 6 are the Personal Adjustment Codes for the user to be applied to the user's pattern pieces.

Figure 14A:
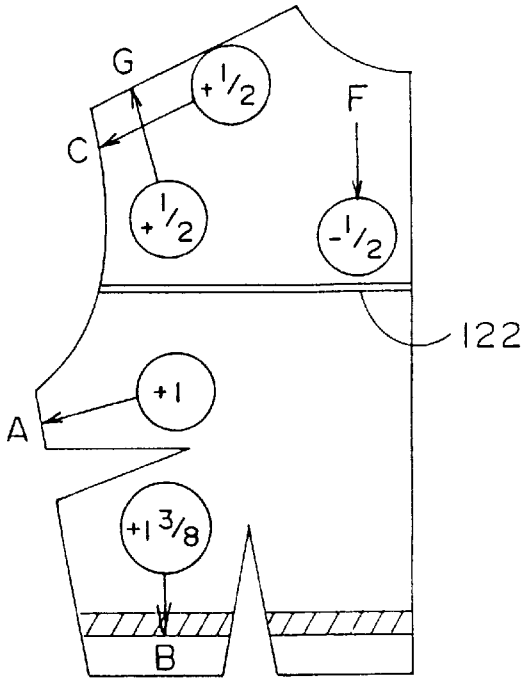
FIG. 14*a* is a front pattern piece showing personal adjustment codes according to the method of the present invention.
Figure 14B:
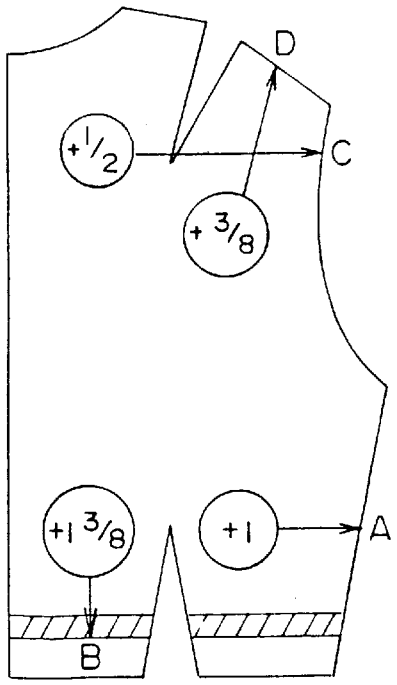
FIG. 14*b* is a back pattern piece showing personal adjustment codes according to the method of the present invention.

For example, in row 8 (bust 42), if the pattern measurement (column 1) is 36 inches, the user's personal measurement (column 2) is 36 inches, then because 4 inches of ease are required, the column 4 entry would be 40 inches, the Overall Adjustment (column 5) entry would be 4 inches and the Adjustment Code (column 6) would be "+1" inch as illustrated in FIGS. 14*a* and 14*b* (front and back pattern pieces respectively) as an expansion adjustment in direction A. Corresponding expansions would then be applied to the sleeve pattern piece, shown as direction A in FIG. 14*c*.

By way of further example, in row 1 (back waist length), if the pattern measurement is 15 inches, the user's personal measurement is 16 inches, then because ⅜ inch of ease is required, the column 4 entry would be 16⅜ inches, the Overall Adjustment entry would be 1⅜ inches, and the Adjustment Code would be "+1⅜" inches, shown in FIGS. 14*a* and 14*b* as an expansion adjustment in direction B.

Figure 14C:
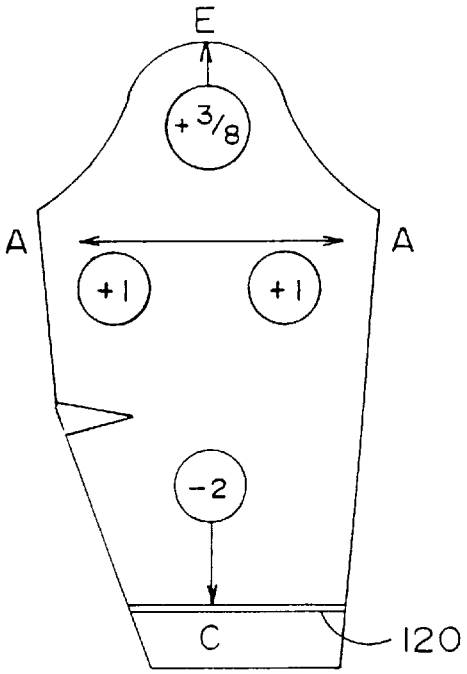
FIG. 14*c* is a sleeve pattern piece showing personal adjustment codes according to the method of the present invention.

As a last example, in row 3 (shoulder to wrist), if the pattern measurement is 24 inches, and the user's personal measurement is 22 inches, then because no ease is required, the column 4 entry would be 22 inches, the Overall Adjustment entry would be 2 inches, and the Adjustment Code would be "−2" inches, shown in FIG. 14*c* as a fold at fold line 120 in direction C.

If shoulder tip-to-shoulder tip expansion is required of 1 inch, then the pattern pieces are expanded in direction C, ½ inch on each of the front (FIG. 14*a*) and back (FIG. 14*b*) pattern pieces.

Further personal adjustment codes are recorded following the fit according to the above steps. In particular, further personal adjustment codes result of squaring the shoulder, and adjusting the front length. These are illustrated in FIGS. 14*a*–14*c* as adjustments in directions D and E (squaring the shoulder) and in direction F (adjusting the front length to lower the front neckline, and the resulting adjustment to the shoulder in direction G).

To construct the basic bodice fitting shell 26, as seen in FIG. 4*b:*

(a) Adjust patterns and fabric for basic bodice fitting shell 26 as set out above for blouse 24.

(b) Using broadcloth, cut out pattern. Mark grain lines.

(c) Construct bodice. Clip around neckline every ⅜ inch (1 cm).

(d) Front neckline should just cover the frontal neck bones.

Figure 15:
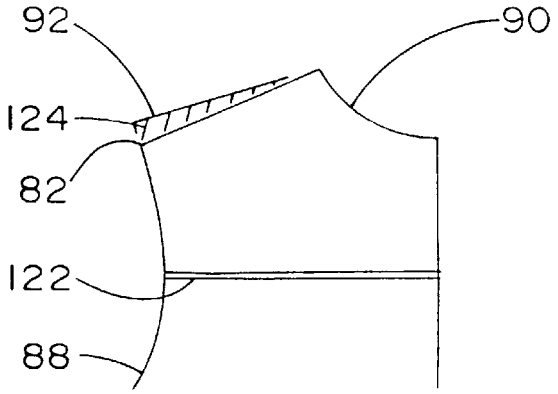
FIG. 15 is, in partial view, a front pattern piece adjusted according to the method of the present invention.

(e) If neckline comes too high, take a tuck at fold line 122 (seen in FIG. 14*a*) at centre front to bring neckline into position. That is, on pattern front as seen in FIG. 9*b* and FIG. 15, taking the fold, fold the same amount of tuck laterally along fold line 122, across front to armscye 88. Thus, if the tuck is ¼ inch (6 mm) take fold across fold line 122 and add amount of fold, ½ inch (1.4 cm), back at shoulder seam 92 by way of expansion adjustment 124, with nothing added at neckline seam as illustrated in FIG. 15.

Figure 16:
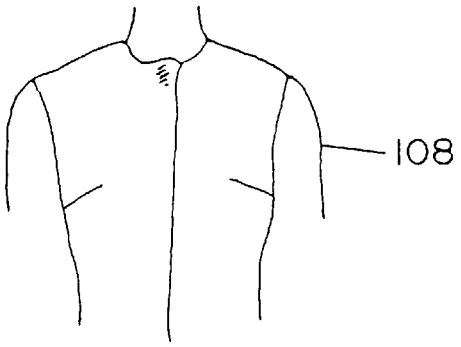
FIG. 16 is, in front elevation view, a garment requiring adjustment for gaping at the neck.

(f) Neckline 90 should not gape. Gaping is illustrated in FIG. 16. If neckline 90 gapes go to next smaller neck size. If neckline 90 is too tight, go to next larger neck size.

(g) Sleeve should hang straight from shoulder without touching arm.

(h) If no further adjustments necessary, develop personal adjustment code, as set out above. The personal adjustment codes should now be applied to every style pattern user chooses in user's own neck size. Flat measure every pattern before adjusting.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A method of selecting a clothing pattern size for a user comprising the steps of:

(a) creating a table based on a neck size, (b) determining a neck size of said user, (c) comparing said neck size to said table, (d) selecting said clothing pattern size from said table corresponding to said neck size.

* * * * *